US010862191B2

(12) United States Patent
Nguyen

(10) Patent No.: US 10,862,191 B2
(45) Date of Patent: Dec. 8, 2020

(54) RADIO FREQUENCY ANTENNA FOR SHORT RANGE COMMUNICATIONS

(71) Applicant: DISH Technologies L.L.C., Englewood, CO (US)

(72) Inventor: Phuc H. Nguyen, Parker, CO (US)

(73) Assignee: DISH Technologies L.L.C., Englewood, CO (US)

( * ) Notice: Subject to any disclaimer, the term of this patent is extended or adjusted under 35 U.S.C. 154(b) by 0 days.

(21) Appl. No.: 16/393,873

(22) Filed: Apr. 24, 2019

(65) Prior Publication Data

US 2019/0252761 A1 Aug. 15, 2019

Related U.S. Application Data

(63) Continuation of application No. 15/582,360, filed on Apr. 28, 2017, now Pat. No. 10,320,055.

(51) Int. Cl.
*H01Q 1/22* (2006.01)
*H01Q 5/30* (2015.01)
(Continued)

(52) U.S. Cl.
CPC ..... *H01Q 1/2266* (2013.01); *H01Q 1/42* (2013.01); *H01Q 1/521* (2013.01); *H01Q 5/30* (2015.01);
(Continued)

(58) Field of Classification Search
CPC ..... H01Q 1/2266; H01Q 5/30; H01Q 1/42; H01Q 1/521; H01Q 9/40; H01Q 9/42; H01Q 21/24
See application file for complete search history.

(56) References Cited

U.S. PATENT DOCUMENTS 6,342,860 B1 * 1/2002 Haussler ..... H01Q 1/243 343/702
6,417,817 B1 7/2002 Pirilä et al.
(Continued)

FOREIGN PATENT DOCUMENTS

CN 201156582 Y 11/2008
DE 20 2006 020 103 U1 11/2007

OTHER PUBLICATIONS

International Search Report and Written Opinion, dated Jul. 6, 2018, for International Application No. PCT/US2018/029943, 13 pages.
(Continued)

*Primary Examiner* — Dameon E Levi
*Assistant Examiner* — David E Lotter
(74) *Attorney, Agent, or Firm* — Seed IP Law Group LLP

(57) ABSTRACT

An antenna assembly includes a substrate, a first antenna having a first, second, third, fourth sections, which have different configuration respectively, and a first transmission cable, a second antenna having a fifth, sixth, seventh, eighth sections, which have different configuration respectively, and a second transmission cable. The first and fifth sections extend vertically from a surface of the substrate respectively. The second, third and fourth sections extend in parallel with the first section and extend from its next section. The sixth, seventh, eighth sections extend in parallel with the fifth section and extend from its next section. The first and second transmission cables physically and electrically are connected to the first and second antenna respectively. The second antenna is spaced away from the first antenna a selected distance. The first antenna is arranged having each of its sections extending perpendicular to each of its sections of the second antenna.

10 Claims, 13 Drawing Sheets

(51) Int. Cl.

| | |
|---|---|
| ***H01Q 1/52*** | (2006.01) |
| ***H01Q 1/42*** | (2006.01) |
| ***H01Q 9/40*** | (2006.01) |
| ***H01Q 9/42*** | (2006.01) |
| ***H01Q 21/24*** | (2006.01) |

(52) U.S. Cl.
CPC ..... *H01Q 9/40* (2013.01); *H01Q 9/42* (2013.01); *H01Q 21/24* (2013.01)

(56) References Cited

U.S. PATENT DOCUMENTS

| | | | |
|---|---|---|---|
| 6,539,207 | B1 | 3/2003 | del Castillo et al. |
| 6,580,395 | B2 | 6/2003 | Koshizaka et al. |
| 7,079,079 | B2 | 7/2006 | Jo et al. |
| 9,070,070 | B2 | 6/2015 | Nguyen |
| 10,170,838 | B2 | 1/2019 | Garcia et al. |
| 2004/0119654 | A1 | 6/2004 | Koyama |
| 2004/0252064 | A1 | 12/2004 | Yuanzhu |
| 2005/0190109 | A1 | 9/2005 | Washiro |
| 2006/0097949 | A1 | 5/2006 | Luebke et al. |
| 2007/0229374 | A1 | 10/2007 | Shimura |
| 2008/0180339 | A1 | 7/2008 | Yagi |
| 2012/0274517 | A1 | 11/2012 | Nagoshi et al. |
| 2013/0088404 | A1 | 4/2013 | Ramachandran et al. |
| 2013/0120215 | A1* | 5/2013 | Shih ..... H01Q 1/243 343/848 |
| 2014/0300518 | A1* | 10/2014 | Ramachandran ..... H01Q 1/243 343/702 |
| 2015/0357718 | A1 | 12/2015 | Singh |
| 2017/0317419 | A1* | 11/2017 | Wu ..... H01Q 5/30 |
| 2017/0324146 | A1* | 11/2017 | Karlsson ..... H01Q 5/50 |
| 2018/0115051 | A1 | 4/2018 | Nguyen |
| 2018/0316081 | A1 | 11/2018 | Nguyen |
| 2020/0153085 | A1 | 5/2020 | Nguyen |

OTHER PUBLICATIONS

International Search Report and Written Opinion, dated Feb. 2, 2018, for International Application No. PCT/US2017/057618, 10 pages.

* cited by examiner

— Farfield (f=5.170) [1]

Frequency = 5.17 GHz
Main lobe magnitude = 4.18 dBi
Main lobe direction = 29.0 deg
Angular width (3 dB) = 85.5 deg
Side lobe level = -2.2 dB — Farfield (f=5.170) [2]

Frequency = 5.17 GHz
Main lobe magnitude = 4.76 dBi
Main lobe direction = 32.0 deg
Angular width (3 dB) = 74.5 deg
Side lobe level = -4.4 dB — Farfield (f=5.5) [1]

Frequency = 5.5 GHz
Main lobe magnitude = 3.99 dBi
Main lobe direction = 29.0 deg
Angular width (3 dB) = 151.5 deg
Side lobe level = -5.0 dB — Farfield (f=5.5) [2]

Frequency = 5.5 GHz
Main lobe magnitude = 4.29 dBi
Main lobe direction = 31.0 deg
Angular width (3 dB) = 77.6 deg
Side lobe level = -2.8 dB — Farfield (f=5.835) [1]

Frequency = 5.835 GHz
Main lobe magnitude = 3.71 dBi
Main lobe direction = 33.0 deg
Angular width (3 dB) = 158.5 deg
Side lobe level = -5.0 dB Farfield (f=5.835) [2]

Frequency = 5.835 GHz
Main lobe magnitude = 3.86 dBi
Main lobe direction = 33.0 deg
Angular width (3 dB) = 79.3 deg
Side lobe level = -1.7 dB

RADIO FREQUENCY ANTENNA FOR SHORT RANGE COMMUNICATIONS

BACKGROUND

Technical Field

Embodiments of the subject matter described herein relate generally to radio frequency (RF) devices and short range communications. More particularly, embodiments of the subject matter relate to an RF antenna assembly using CST Microwave Studio to model the antenna assembly and simulated radiation polar plots, input return loss, antenna port isolation, and antenna efficiency performance.

Description of the Related Art

The prior art is replete with systems, devices, and components that support wireless data communication in one form or another. For example, most (if not all) portable computer-based devices (laptop computers, tablet computers, smartphones, and video game platforms) support wireless communication in accordance with the Wi-Fi communication protocol, the Bluetooth communication protocol, cellular communication protocols, and the like. Moreover, many consumer products and appliances are also being offered with native wireless data communication capabilities. For example, television equipment, DVD players, audio equipment, and video services receivers (set top boxes) may be provided with native Wi-Fi and/or Bluetooth communication features. Each of these wireless devices may transmit at different frequencies and using a different protocol. It is beneficial to have an antenna system that is able to operate at many different frequencies and fit in a small space. Such wireless data communication requires data transmission in accordance with a specific data communication protocol, a radio frequency (RF) antenna, and a suitable antenna structure configured to transmit and receive signals.

It can be challenging to design and implement an efficient antenna assembly that will operate for all the expected frequencies. In some instances, many antennas might be used, but each antenna takes up space. It may be difficult to deploy and position an RF antenna assembly in compact form for different applications where space is limited or otherwise restricted.

Accordingly, it is desirable to have a compact, efficient, and effective HF antenna structure that can receive many different frequencies that is suitable for use with host device, such as a video services receiver, an appliance, or the like. Furthermore, other desirable features and characteristics of the present invention will become apparent from the subsequent detailed description and the appended claims, taken in conjunction with the accompanying drawings and the foregoing technical field and background.

BRIEF SUMMARY

An exemplary embodiment of an antenna assembly includes a substrate and an antenna having a first, second, third, and fourth sections, which have different configurations respectively, and a transmission cable. The transmission cable has a first end physically and electrically connected to the antenna.

Another exemplary embodiment of an antenna assembly includes a substrate, a first antenna having a first, second, third, fourth sections, which have different configuration respectively, and a first transmission cable, a second antenna having a fifth, sixth, seventh, eighth sections, which have different configuration respectively, and a second transmission cable. A first and second transmission cables physically and electrically are connected to the first and second antenna respectively.

BRIEF DESCRIPTION OF THE SEVERAL VIEWS OF THE DRAWINGS

A more complete description of the subject matter is provided in the detailed description and claims, in conjunction with the following figures. Like reference numbers refer to similar elements throughout the figures.

DETAILED DESCRIPTION

Figure 1:
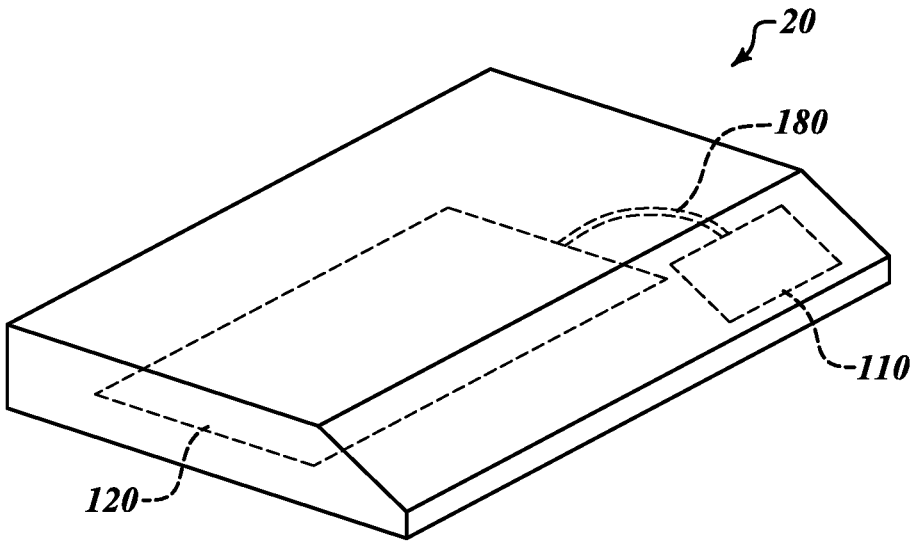
FIG. 1 is a front isometric view of a set-top box including an antenna board with an antenna assembly according to one embodiment of the present disclosure.

In FIG. 1 shows a set-top box 20 having a mother board 120 and an antenna assembly 110 are installed. An input/output transmission cable 180 connects the mother board 120 with the antenna assembly 110. It should be understood that the set-top box 20 will include additional components, features, devices, hardware, DVD player, hard drive to store video data, software, and processing logic that cooperate to provide the desired video services functionality, as is well known in the art. Thus, although not shown in FIG. 1, the set-top box 20 may also include, without limitation: one or more printed circuit boards, power supply or power regulation components, electronic components and devices, memory elements, a hard disk, one or more processor chips, and the like. These and other conventional aspects of the set-top box 20 will not be described in detail here. The transmission cable 180 has an appropriate length that allows it to span the distance between the antenna assembly 110 and the mother board 120.

Figure 2:
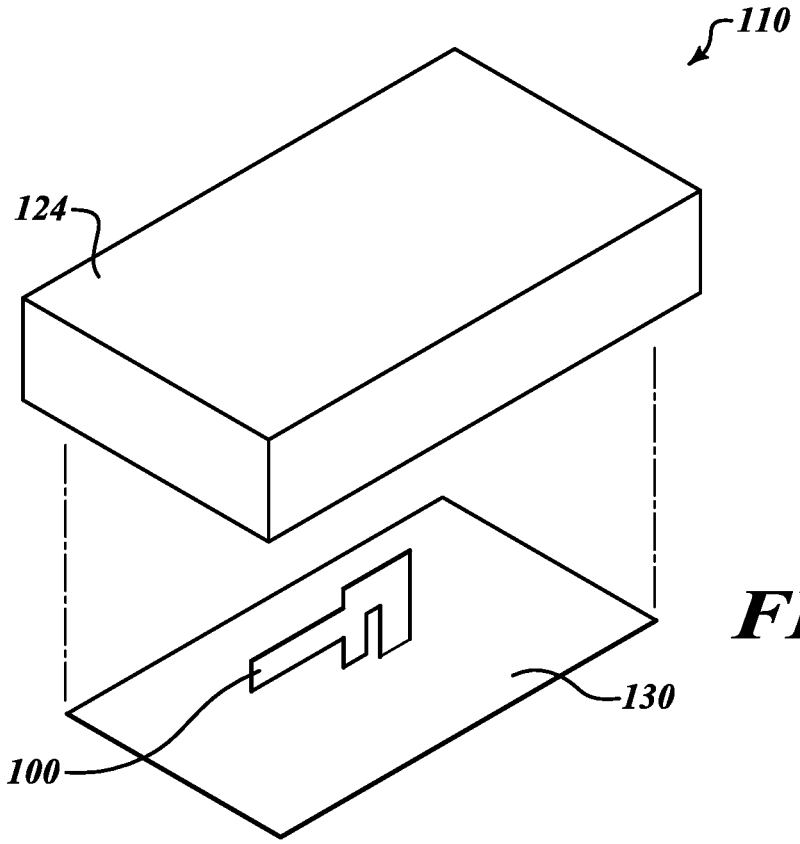
FIG. 2 is an exploded view of the antenna assembly according to the one embodiment of the present disclosure.

In FIG. 2, one embodiment of the antenna assembly 110 is shown. In this embodiment, the antenna assembly 110 may include a cover 124. The antenna assembly 110 comprises a metal substrate 130, a single antenna 100 and a first transmission cable 140, not shown in FIG. 2. The antenna 100 includes a first section 131, a second section 133, a third section 135, and a fourth section 137, which each have a different configuration respectively. Details of the configuration of each section is described later with respect to FIG. 7. A transmission cable 180, as shown in FIG. 1, but not shown in FIG. 2 for ease of illustration, connects the antenna assembly 110 to the mother board 120.

The antenna assembly 110 supports wireless data communication functions of the set-top box 20. The antenna assembly 110 is configured to receive, transmit, and process data in accordance with one or more wireless communication protocols and frequencies.

Furthermore, the antenna assembly 110 also supports wireless data communication functions of the set-top box 20, such as short-range peer-to-peer wireless communication, wireless local area network (WLAN) communication, Internet connectivity, or the like. The data received/transmitted by the antenna assembly 110 can be routed by, processed by, or otherwise handled by one or more other components, processing modules, or devices of the set-top box 20.

Figure 3:
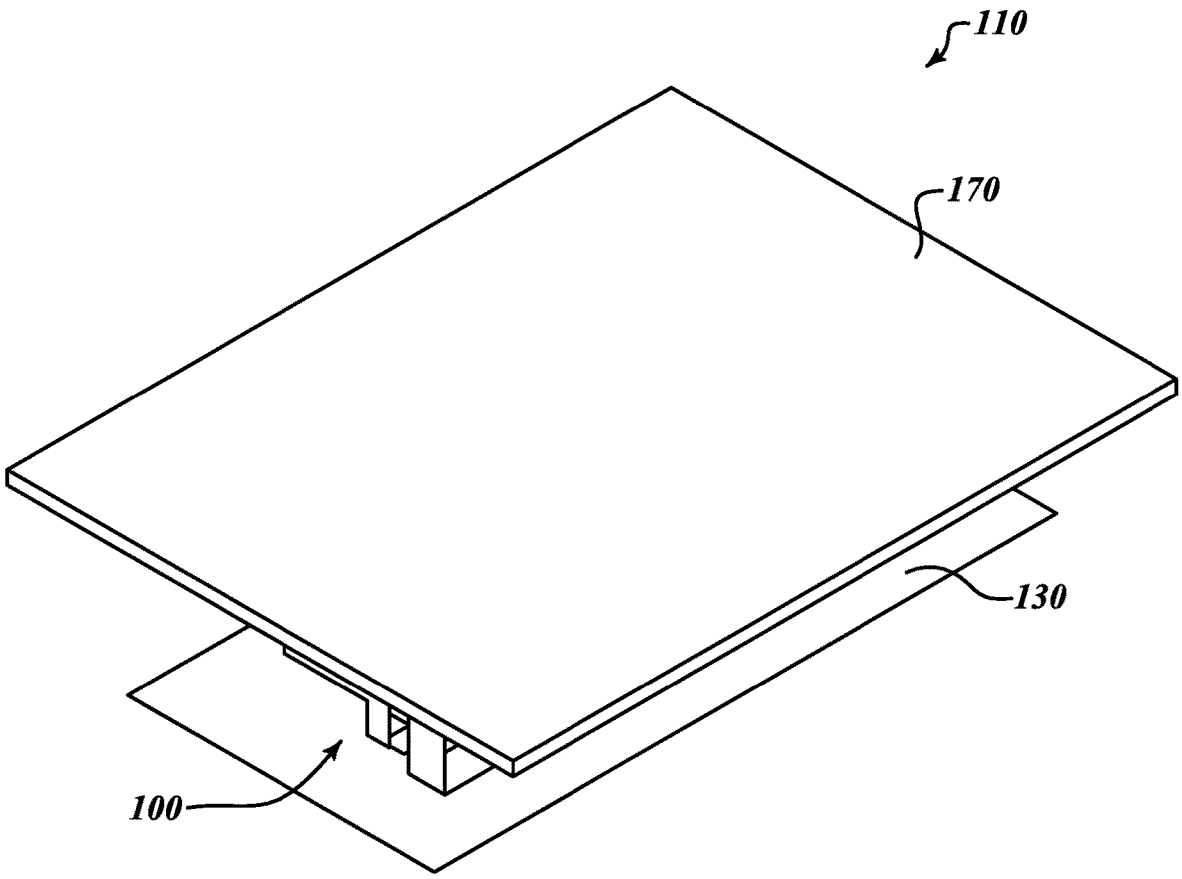
FIG. 3 is an isometric view of the antenna assembly according to another embodiment of the present disclosure.

In FIG. 3, another exemplary embodiment of the antenna assembly 110 is shown. In this embodiment, there are two antennas extending from the substrate, as will be shown in FIG. 4.

Figure 4:
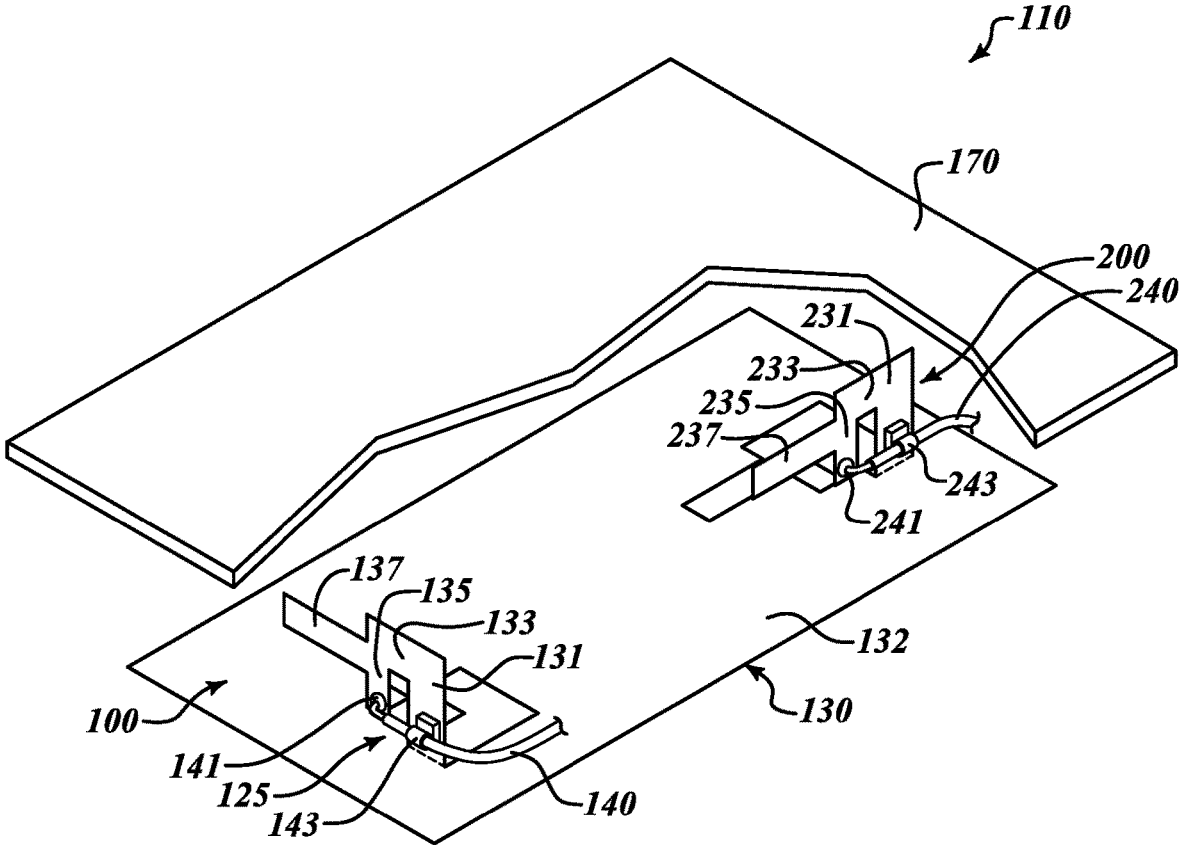
FIG. 4 is an exploded, isometric view of the antenna assembly of FIG. 3.

FIG. 4, a partially exploded view of the antenna assembly 110 is shown to more clearly illustrate the components. In addition to the first (single) antenna 100, the second antenna 200 is also present on the substrate 130. The antenna assembly 110 comprises a substrate 130, the first antenna 100, a first transmission cable 140, a second antenna 200 and a second transmission cable 240. The first and second transmission cables are combined into a single cable to become cable 180 as shown in FIG. 1. The second antenna 200 is spaced away from the first antenna 100 a selected distance, for isolation to prevent antenna port mutual coupling, and includes of a fifth section 231, a sixth section 233, a seventh section 235, and an eighth section 237. The first transmission cable 140 on the first antenna 100 has two terminals in the antenna board, a signal terminal 141 that is soldered directly to the third section 135 of the first antenna 100 and a ground terminal 143 that is soldered directly to the surface 132 of the metal substrate 130 that acts as ground. The transmission cable 240 has also same structure as the first transmission cable 140 and has two terminals, a signal terminal 241 that is soldered directly to the seventh section 235 of the second antenna 200 and a ground terminal 243 that is soldered directly to the surface 132 of the metal substrate 130 that acts as ground. In a preferred embodiment, the substrate 130 may be comprised of a metal, such as stainless steel. Of course, the substrate 130 can be other well known materials, such as copper, carbon steel, a conductive plastic, a printed circuit board or other substrate that can provide physical support for the antennas and preferably also a ground connection, though the ground terminal and the substrate 130 can be provided as separate structures if desired. The benefit to making the substrate from a steel, such as stainless steel is that the antennas 100 and 200 can be stamped from the substrate and bent, as explained in FIGS. 5 and 6.

The first antenna 100 is arranged having each of its sections 100 extending perpendicular or orthogonal to each of the sections of the second antenna 200. In an exemplary embodiment of arrangement between the first and second antenna 100, 200, the sections of the second antenna 200 extend in a line that points to and aligns with the first section of the first antenna 100 which allows for antenna diversity polarization. Furthermore, the configuration of the substrate 130 is rectangle.

In one exemplary embodiment of the antenna assembly 110, the antenna assembly 110 further includes an upper plate 170. The upper plate 170 is positioned over the first antenna 100 and the second antenna 200, and comprised of plastic. Any acceptable plastic can be used, one preferred plastic is Wonderlite PC 122. This is a type of polycarbonated resin. Preferably, the plastic acts as a protective shield to keep the antennas 100 and 200 from being bent or crushed while in the set top box 20. It can be a physically separate element that overlays the antenna assembly, as shown in FIG. 4 or it can be connected to it, as shown in FIG. 2. In one embodiment of a way of the arrangement the upper plate 170 is connected to the substrate 130 of the antenna assembly 110 covering the first and second antenna 100, 200. The upper plate 170 is positioned over the substrate 130 and larger than the substrate 130. In one embodiment, thickness of the upper plate 170 is thicker than that of the substrate 130. In other embodiment, the height between the upper plate 170 and the substrate 130 is shorter than the sum of the total width of the first, second, third and fourth sections of the first antenna 100. In other embodiment, the height between the upper plate 170 and the substrate 130 is longer than the sum of the total width of the first, second, third and fourth sections of the first antenna 100. Depending on the proximity of the upper plate 170 to the first antenna 100 and second antenna 200, a magnetic coupling effect of the upper plate 170 could change the resonant effects of the first antenna 100 and second antenna 200.

In one exemplary embodiment the upper plate 170 has a width, length, and thickness of 56.38 mm, 42.95 mm, and 1.14 mm, respectively. The substrate 130 has a width, length, and thickness of 52.83 mm, 26.04 mm, and 0.30 mm, respectively. Furthermore, in one embodiment of the upper plate 170 is 12.21 mm above the substrate 130. It overlaps the substrate 130 on both the width and length to provide the desired protection.

The first transmission cable 140 (which may be realized as an coaxial cable in some embodiments) has a first end 125 with two terminals, a signal terminal 141 and a ground terminal 143. A second end of the transmission cable 140 is connected to the mother board 120 and includes a compatible connector that is configured to mate with a connector on the mother board 120, not shown. The first end 141 may be otherwise designed to mate with the antenna 100 by way of a solder connection, a press-fit coupling, or the like. As one non-limiting embodiment, the connector may be a miniature coaxial connector such as a "Hirose U.FL" connector, sometimes also referred to as UFL connector. A similar type of connection could be utilized to physically and electrically couple the first transmission cable 140 to the antenna board. The second transmission cable 240 of the second antenna 200 also has the same structure. The two cables 140 and 240 correspond to the cable 180 of FIG. 1 and in most embodiments, will be coupled to each other to extend to the motherboard 120 as a single cable, but this is not required.

Figure 5A:
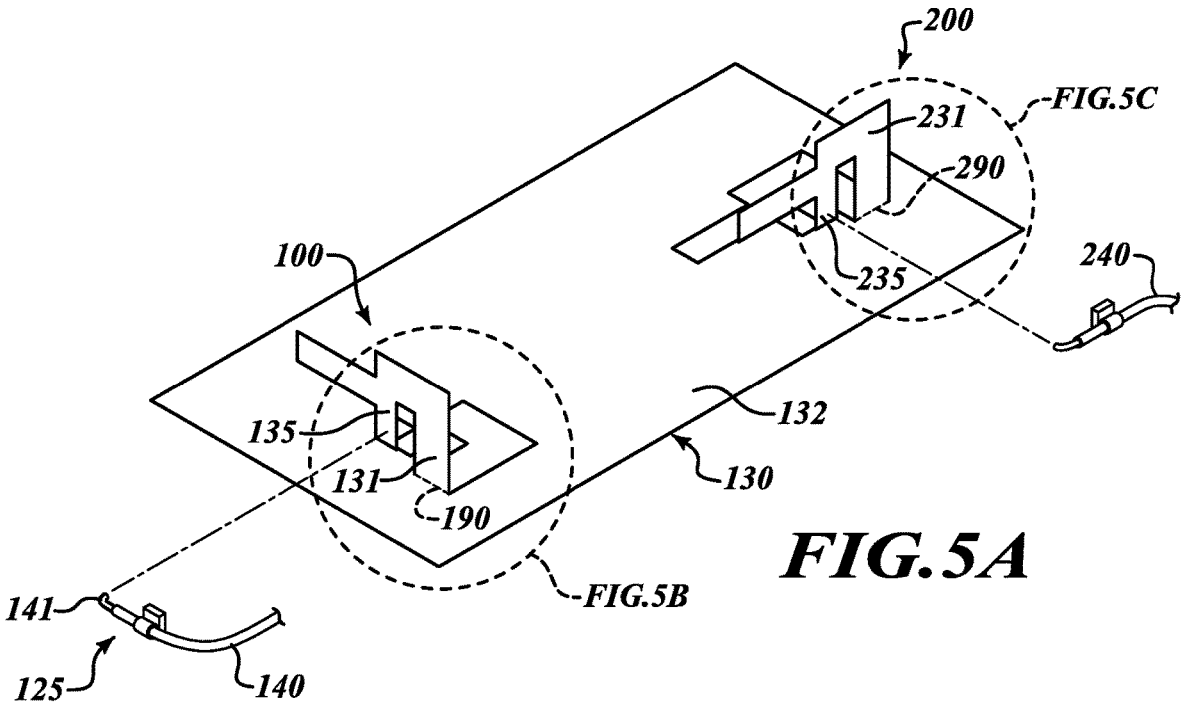
FIG. 5A is a top isometric view of ending steps in the process of forming the antenna assembly according to the embodiment of FIG. 3.
Figure 6:
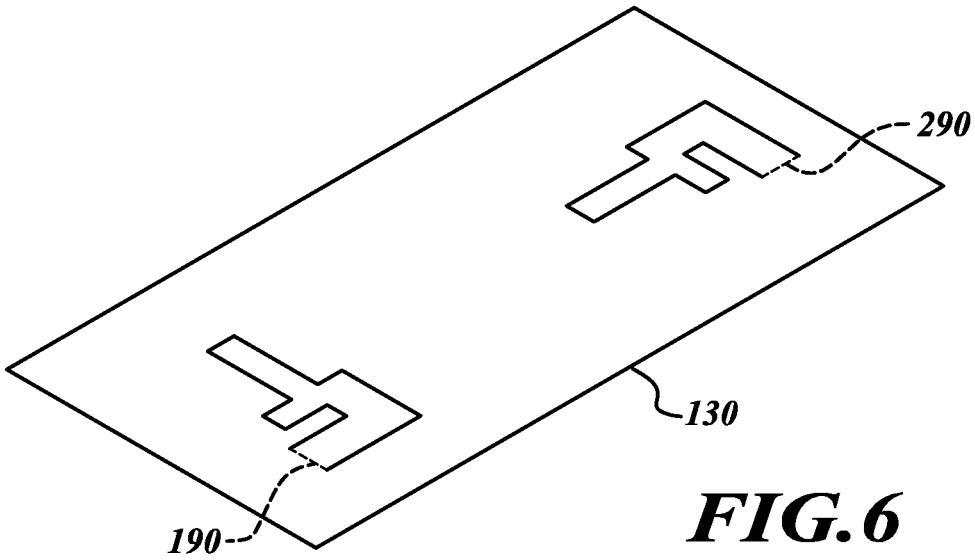
FIG. 6 is a top isometric view of starting steps in the process of forming the antenna assembly according to the embodiment of FIG. 3.

Referring now to FIGS. 5A and 6, the process of forming the first and second antenna 100, 200 is shown. Viewing FIG. 6, the substrate 130 starts as a flat sheet, which acts as a ground plane for the antennas. It is usually in the form of a large flat sheet from which several, even several hundred antennas can be stamped in a single press. The large flat sheet is stamped to form a plurality of single flat sheets 130, only one of which is shown in FIG. 6. In the same stamping step, the first antenna 100 and the second antenna 200 are also stamped out. Thus, in a single stamping step, several dozen or hundred flat sheets 130 can be stamped, and thus individual sheets 130 can be separated from the large sheet in the same stamping step with the creation of the shape of the antennas 100 and 200. This saves time and money. Dotted lines 190 and 290 in FIG. 6 show where the sheet 130 is to be bent to form the antenna structure of each of the antennas 100 and 200. The first section 131 of antenna 100 is bent to extend vertically from the surface 132 of the substrate 130 along the dotted line 190. Similarly, the fifth section 231 of the second antenna 200, which corresponds to the first section 131 of the first antenna is also bent to extend vertically from the surface 132 of the substrate 130 along the dotted line 290 as shown in FIGS. 5A and 6.

Figure 7:
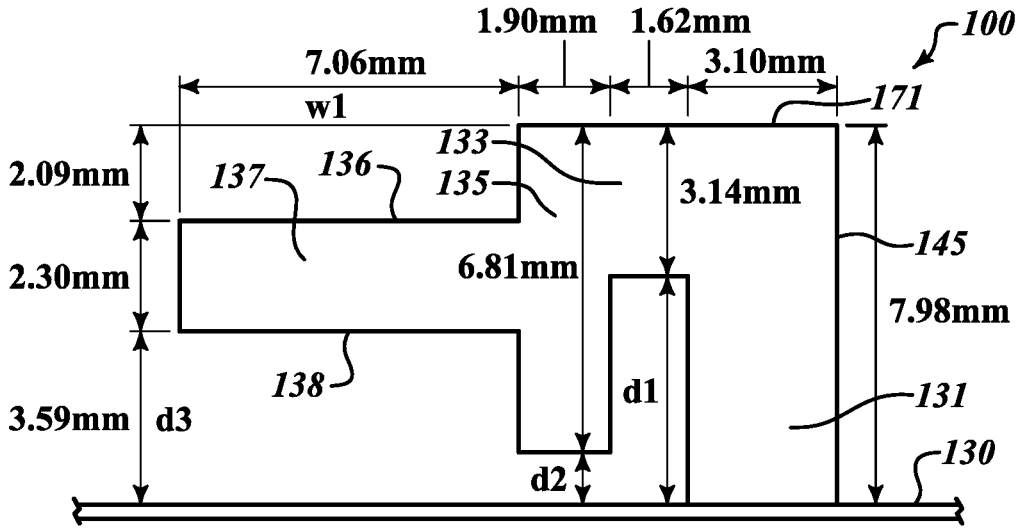
FIG. 7 is a side view of a first antenna according to one embodiment of the present disclosure.

As seen in FIGS. 5A-6, the third section 135 is physically separate from the substrate surface 132. The open space between the substrate surface 132 and the third section 135 permits that section to be a preferred location for the antenna signal to be picked up on the signal terminal 141 of the transmission cable 140 as illustrated in FIGS. 4 and 7. The substrate 130 is formed from an electrically conductive material such as, without limitation, stainless steel, carbon steel, copper, aluminum, alloys thereof, or the like. The first section 131 extends vertically to a selected height to create an appropriate distance that allows the second, third, fourth and other sections to function as an antenna resonating elements. Of course, the third section 135 can have a contact with the first end 125 of the transmission cable 140 by way any known connection, such as a solder connection, a press-fit coupling, or the like.

Figure 5B:
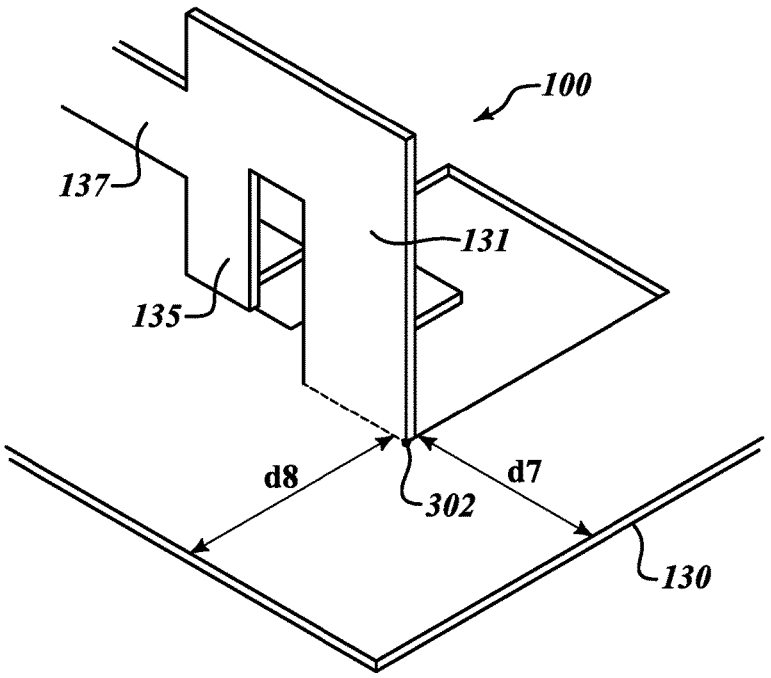
In FIG. 5B, an enlarged isometric view of the placement of the first antenna on the substrate.
Figure 5C:
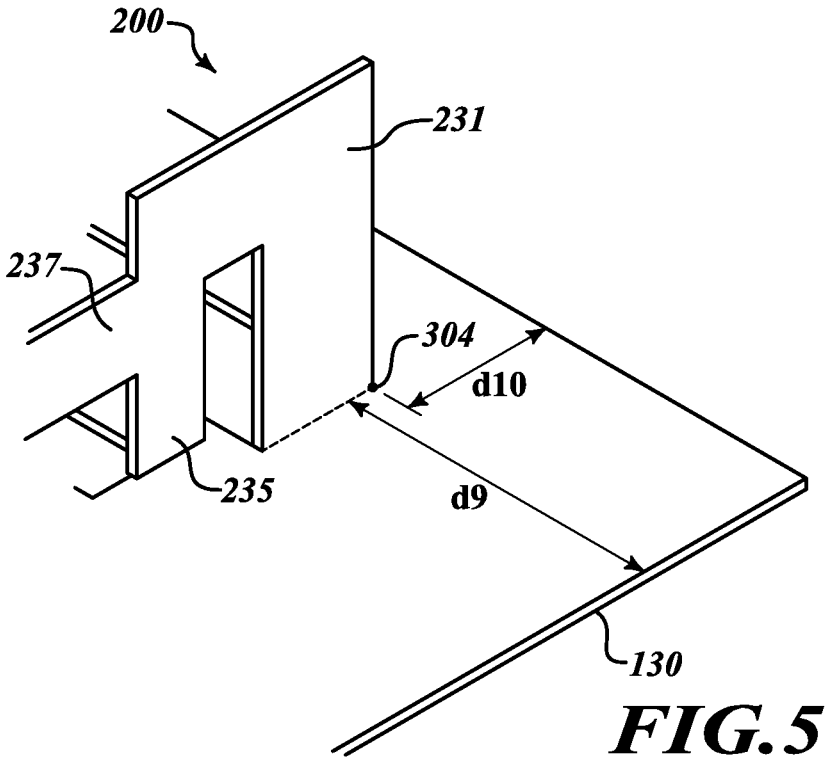
In FIG. 5C, an enlarged isometric view of the placement of the second antenna on the substrate.
Figure 11:
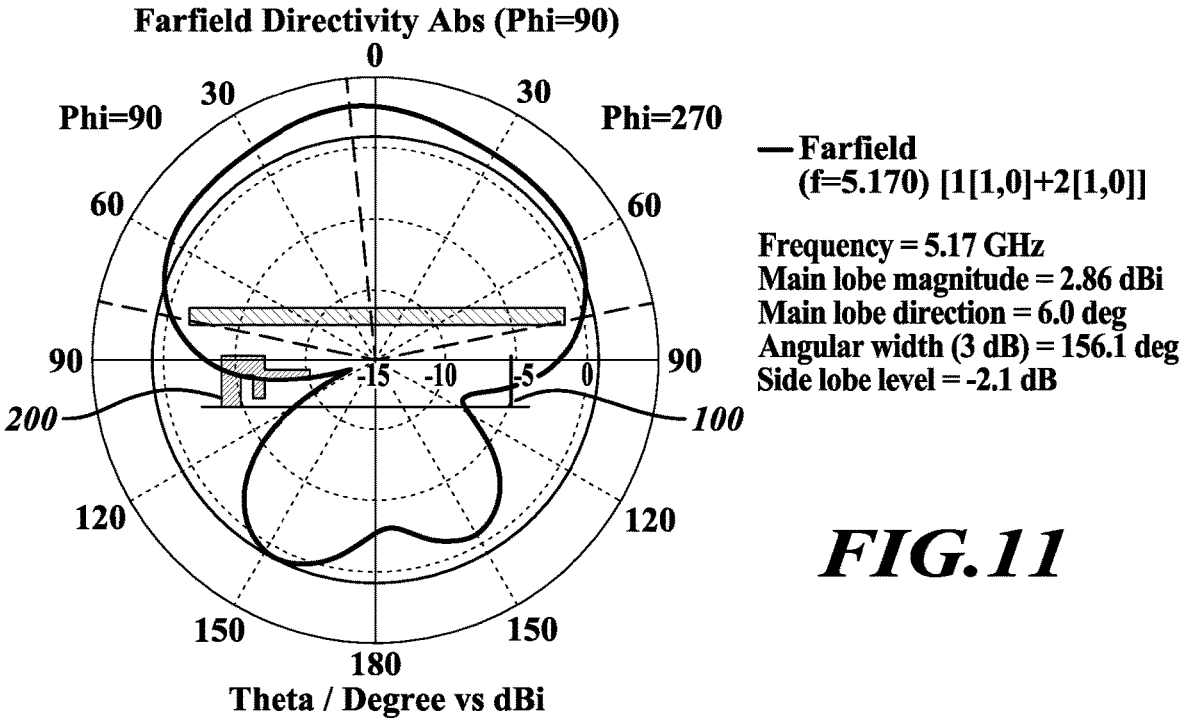
FIGS. 11, 14, and 17 are combined radiation patterns of the first antenna and the second antenna at the selected frequencies according to the embodiment of FIG. 3.
Figure 14:
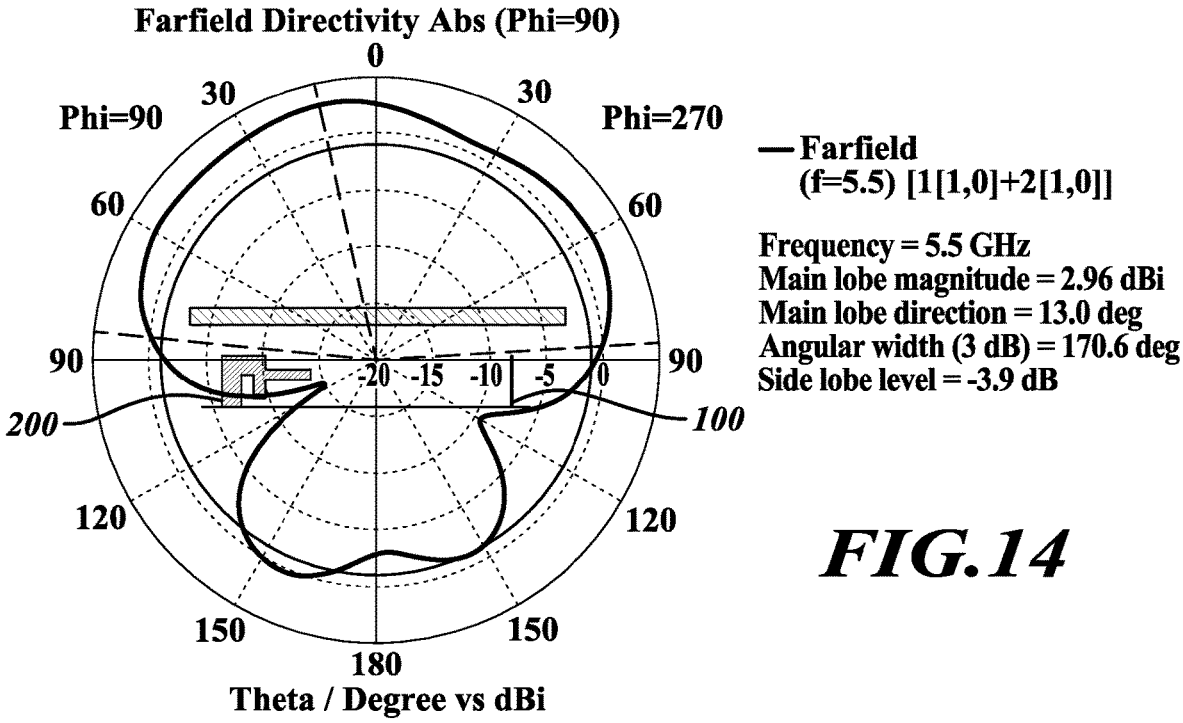
Figure 17:
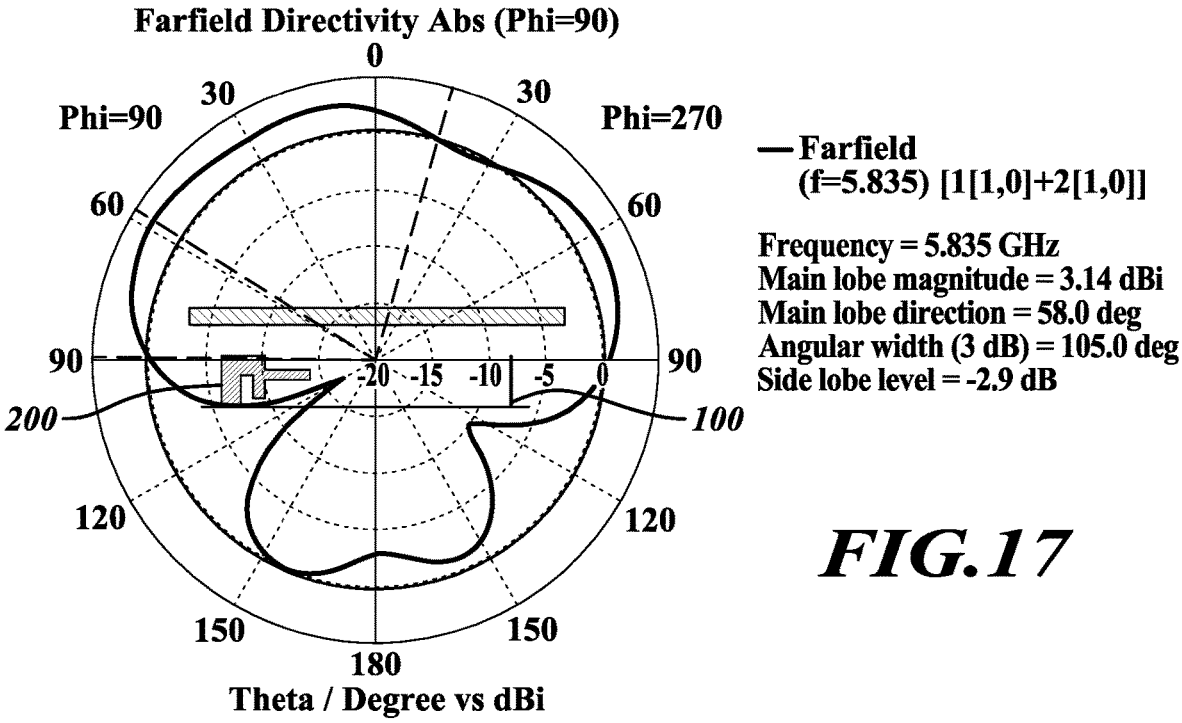

In FIGS. 5B and 5C, the details of the location of the first and second antenna 100, 200 on the substrate 130 are shown. These show one embodiment of the location of the first antenna 100 on the substrate 130. The space from an edge of the substrate 130 and corner 302 of section 131 of the first antenna 100 which are nearest the edge of the substrate are 5.26 mm, 5.62 mm, for distance d7 and d8, respectively. For antenna 200, the distance between an edge of the substrate 130 and corner 304 of fifth section 231 the second antenna 200 which is nearest the edge of the substrate are 8.11 mm and 3.07 mm, for distance d9 and d10, respectively. Having provided the placement locations of the antennas 100 and 200 on the sheet 130, as well as the dimensions of the sheet 130, a person of skill in the art can easily determine their spacing, orientation and relationship to each other. As can be seen, they extend perpendicular to each other, with antenna 200 pointing at and generally aligned with the central region 131 of antenna 100. This also provides the information need to more fully appreciate and understand the combined radiation patterns of both antennas, as shown in FIGS. 11, 14 and 17. For a different spacing and orientation, the combined radiation patterns will be different. Of course, in other embodiments, the two antennas can be positioned at different locations and have a different orientation with respect to each other. One example has been provided to illustrate the concept and operation, but other shapes, sizes, orientations, spacings, dimensions and relative dimensions can also be used within the bounds of the claimed invention.

In FIG. 7, a side view of the first antenna 100 is shown. The first antenna 100 includes the first, second, third, and fourth sections 131, 133, 135, 137. The first section 131 includes a back edge 145 that extends vertically a selected height h1 from a surface of the substrate 130. The first section has a top edge 171. The second section 133 extends from the first section 131 in parallel with the first section 131. The lower edge of the second section 133 is separated from the substrate 130 by a first distance d1. The upper edge of the second section 133 is aligned with the upper edge of the first section 131 to form a continuous single edge 171.

The third section 135 extends from the second section 133 in parallel with the second section 133. The lower edge of the third section 135 positioned is separated from the substrate 130 by a second distance d2. The second distance is shorter than the first distance d1. The upper edge of the third section 135 is aligned the upper edge of the second section 133, as part of the edge 171. The fourth section 137 extends from a middle region of the third section 135 in parallel with the third section 135. The width, w1, of the fourth section 137 is wider than the sum of the total width of the first, second, and third sections. The upper edge 136 of the fourth section 137 is positioned higher than the lower edge of the second section 133. The lower edge 138 of the fourth section 137 is positioned separated from the substrate 130 by a third distance, d3. The third distance is greater than the second distance and shorter than the first distance.

In one embodiment of configuration of the first antenna 100, as shown in FIG. 7, the height of the first section 131 is 7.98 mm, the width of the first section 131 is 3.10 mm, the height of the lower edge of the second section 133 is 4.84 mm as the first distance, the width of the second section 133 is 1.62 mm, height of the lower edge of the third section 135 is 1.17 mm as the second distance, the width of the third section 135 is 1.90 mm, the height of the upper edge of the fourth section 137 is 5.92 mm, the height of the lower edge of the fourth section 137 is 3.62 mm as the third distance, width of the fourth section 137 is 7.06 mm. The antenna 100 can, of course, be a different size and the ratio of the sections relative to each other can still be maintained.

Figure 8:
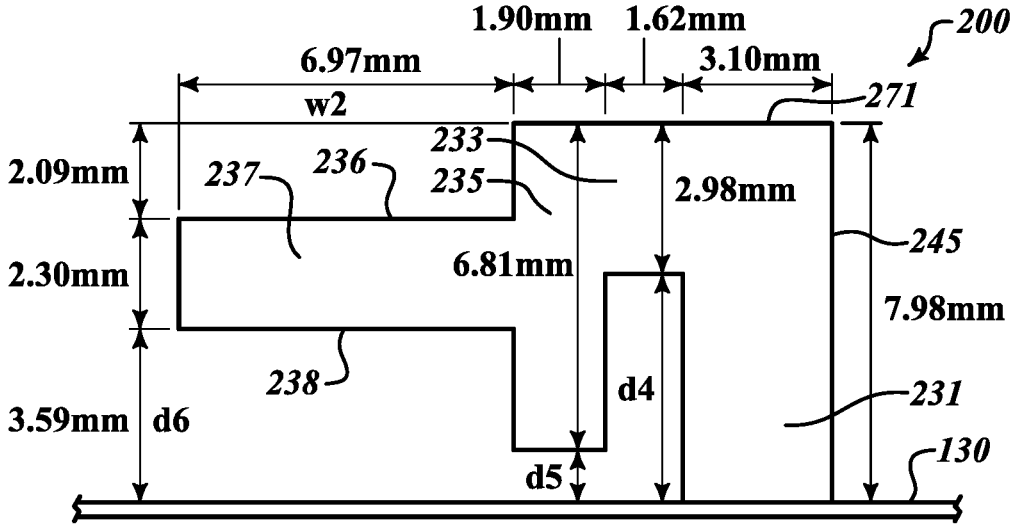
FIG. 8 is a side view of a second antenna according to another embodiment of the present disclosure.

In FIG. 8, a side view of the second antenna 200 is shown. The second antenna 200 includes the fifth, sixth, seventh, and eighth sections 231, 233, 235, 237, respectively. The fifth section 231 includes a back edge 245 that extends vertically from the surface of the substrate 130. The fifth section has a top edge 271. The sixth section 233 extends from the fifth section 231 in parallel with the fifth section 231. The lower edge of the sixth section 233 is separated from the substrate 130 by a fourth distance, d4. The upper edge of the sixth section 233 is aligned with the upper edge of the fifth section 231 to form a single, continuous upper edge 271. The seventh section 235 extends from the sixth section 233 in parallel with the sixth section 233. The lower edge of the seventh section 235 is positioned separated from the substrate 130 by a fifth distance, d5. The fifth distance is shorter than the fourth distance. The upper edge of the seventh section 235 is aligned the upper edge of the sixth section 233 as part of the edge 271. The eighth section 237 extends from a middle region of the seventh section 235 in parallel with the seventh section 235. The width, w2, of the eighth section 237 is wider than the sum of the total width of the fifth, sixth, and seventh sections, the upper edge 236 of the eighth section 237 positioned is higher than the lower edge of the sixth section 233. The lower edge 238 of the eighth section 237 positioned is separated from the substrate 130 by a sixth distance d6. The sixth distance is longer than the fifth distance and shorter than the fourth distance.

In one embodiment, the shape of the fifth, sixth, seventh, and eighth sections are respectively same as the first, second, third, fourth section of the first antenna 100. As can be seen, the first antenna and the second antenna have the same general shape. However, the exact physical dimensions are slightly different from each other, as are the ratios of the various sections to each other. This provides a different radiation pattern of the two antennas, as explained elsewhere herein. In another embodiment, configuration of the second antenna 200 is not same as the first antenna 100. The fourth distance of the second antenna 200 is longer than the first distance of the first antenna 100, and the width of the eighth section of the second antenna 200 in lateral direction is shorter than the width of the fourth section of the first antenna 100.

Furthermore, in another embodiment, the fifth distance of the second antenna 200 is same as the second distance of the first antenna 100, and the sixth distance of the second antenna 200 is shorter than the third distance of the first antenna 100.

In one embodiment of configuration of the second antenna 200, the height of the fifth section 231 is 7.98 mm, the width of the fifth section 231 is 3.10 mm, the height of the lower edge of sixth section 233 is 5.00 mm as the fourth distance, width of the sixth section 233 is 1.62 mm, the height of the lower edge of the seventh section 235 is 1.17 mm as the seventh distance, the width of the seventh section 235 is 1.90 mm, the height of the upper edge of the eighth section 237 is 5.88 mm, the height of the lower edge of the eighth section 237 is 3.58 mm as the sixth distance, the width of the eighth section 237 is 6.97 mm. In one embodiment, the first, second, third, and fourth sections of the first antenna may be an integral, single piece. Also the fifth, sixth, seventh, and eighth sections of the second antenna may be an integral, single piece. The first, second, third and fourth sections, and fifth, sixth, seventh, and eighth sections may be comprised of metal.

Figure 9:
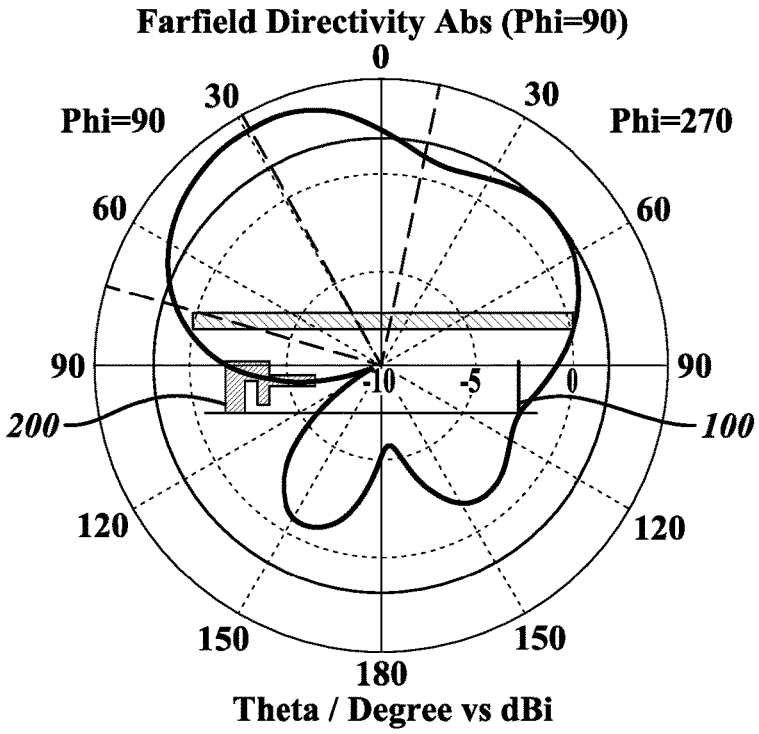
FIGS. 9, 12 and 15 are radiation patterns of the first antenna at certain selected frequencies according to the embodiment of FIG. 3.
Figure 10:
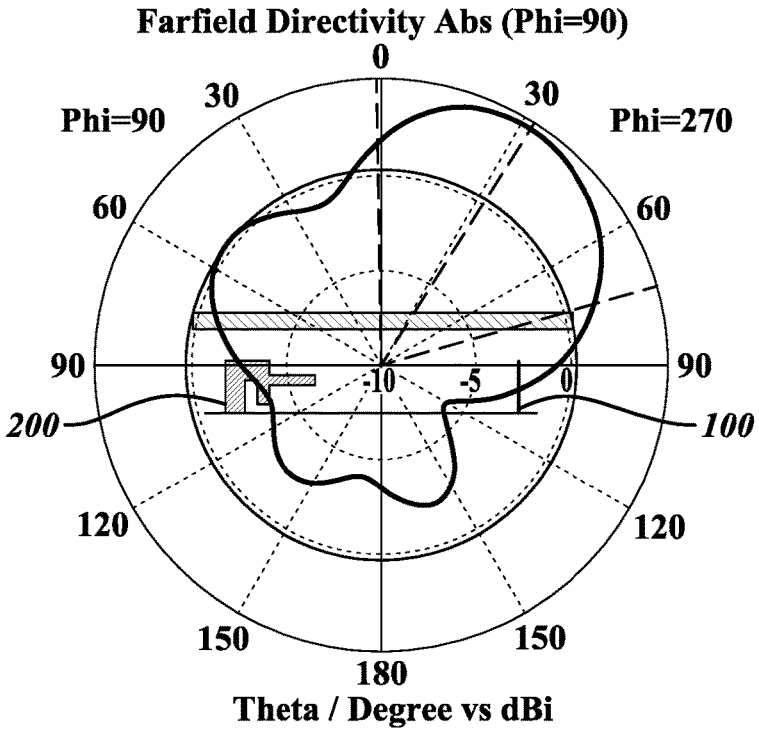
FIGS. 10, 13 and 16 are radiation patterns of the second antenna at the selected frequencies according to the embodiment of FIG. 3.

In FIGS. 9, 10 and 11, radiation patterns of the first antenna 100 and the second antenna 200 and combined radiation pattern of the first and second antenna 100, 200 are shown for a broadcast frequency at 5.170 GHz.

Figure 12:
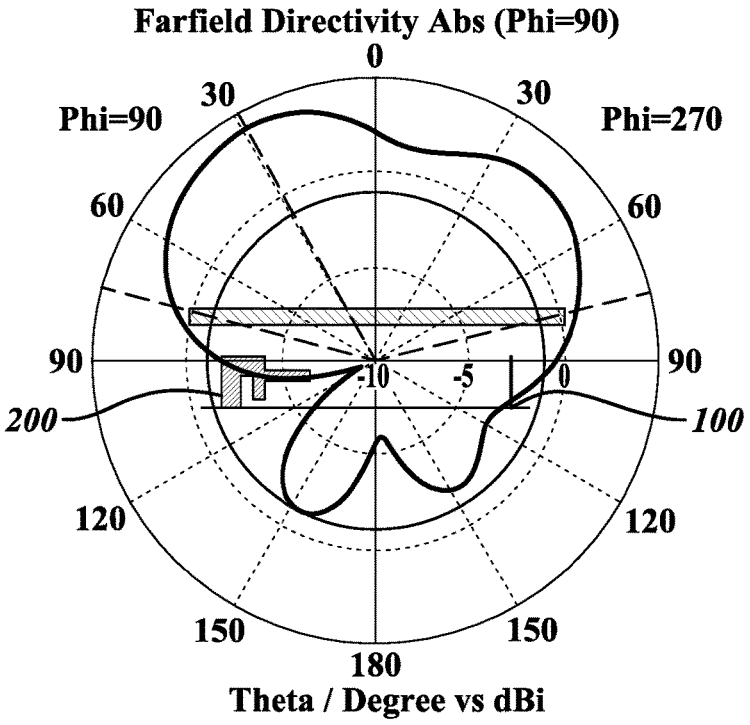
Figure 13:
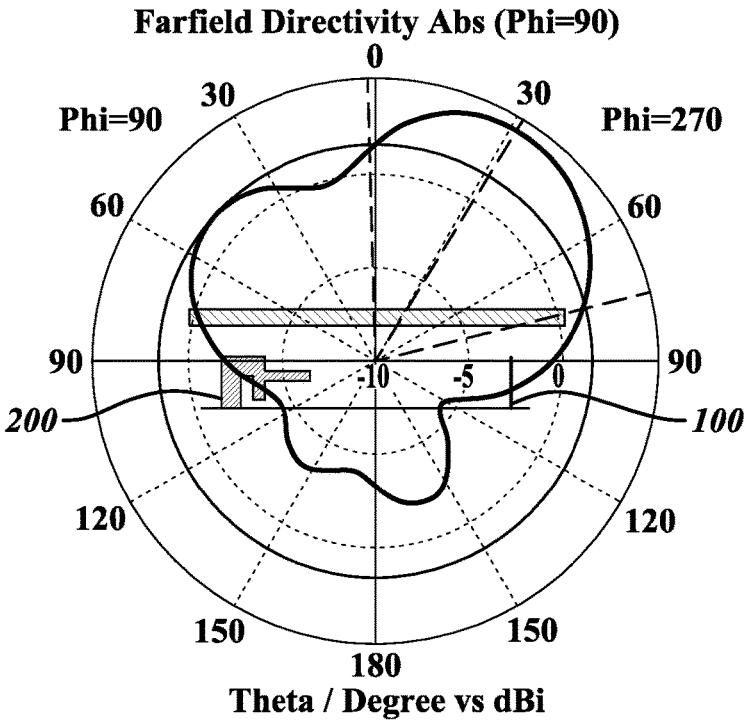

In FIGS. 12, 13 and 14, radiation patterns of the first antenna 100 and the second antenna 200 and combined radiation pattern of the first and second antenna 100, 200 are shown for a broadcast frequency at 5.500 GHz.

Figure 15:
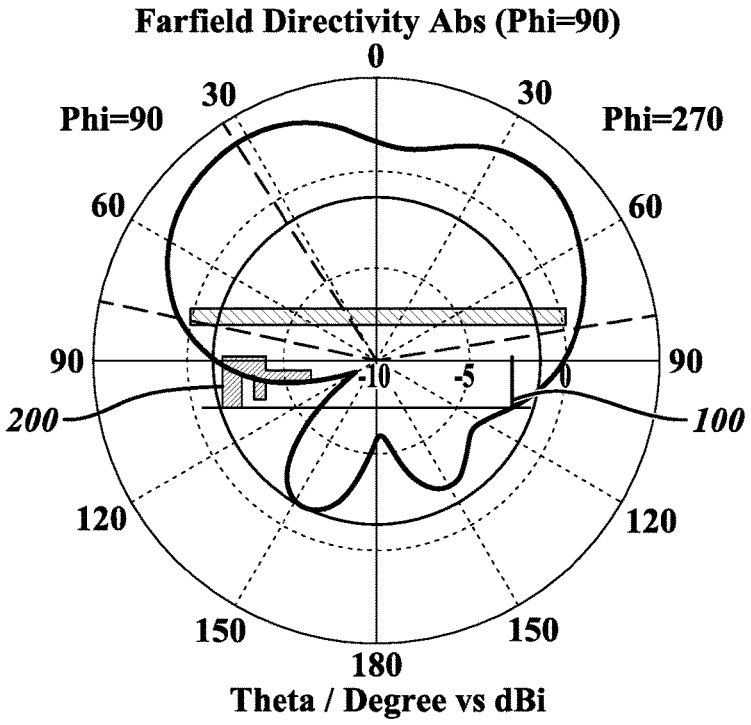
Figure 16:
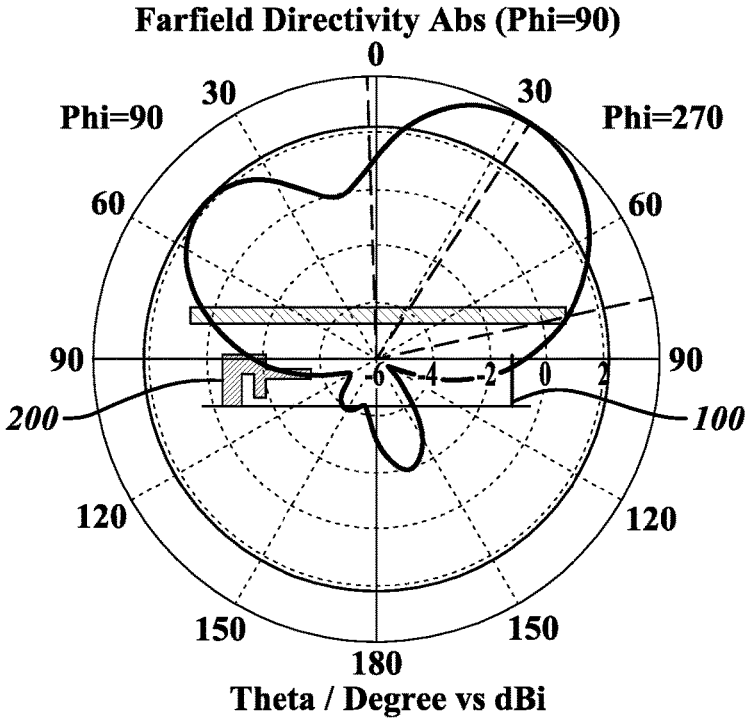

In FIGS. 15, 16 and 17, radiation patterns of the first antenna 100 and the second antenna 200 and combined radiation pattern of the first and second antenna 100, 200 are shown for a broadcast frequency at 5.835 GHz.

The far-field radiation polar plots of FIGS. 9-17 are of a type well known in the art and thus are not described in great detail in this text. As the figures show, each plot has a main lobe magnitude and direction, as well as side lobes. The shape and details of the radiation pattern for each antenna and for the combined antennas at the respective frequencies can be seen in the plots and therefore, a further description need not be provided here.

As shown in FIGS. 9-16, the radiation patterns of the first antenna 100 or second antenna 200 show the high directivity and high magnitude at the main lobe direction. In FIGS. 11, 14 and 17, combined radiation patterns of the first and second antenna 100, 200 (shown at low, mid, high regions in the 5 GHz band) show wider directivity and angular width of the combined antenna is much wider than that of the first antenna 100 or second antenna 200.

Accordingly, the antenna assembly 110, with both antennas, has a compact, efficient, and effective antenna structure. Furthermore, the first and second antenna 100, 200 may be compatible with one or more of the following wireless data communication protocols, without limitation: IEEE 802.11 (any variant), also known as Wi-Fi; the Bluetooth wireless protocol; and IEEE 802.15, also known as ZigBee. While only three examples of frequencies are shown, it will be known to those skilled in the art that these antennas support a wide range of frequencies. They have particular benefit for frequencies in the range of 4.8 GHz to 6.2 GHz, with a preferred range being 5.1 GHz to 5.9 GHz. They will also be very effective antennas for outputting signals in the 2.1-2.9 GHz range. There are many signals in the short range signals, such as Bluetooth or Wi-Fi that are in the 2.1 to 3.5 GHz range and these antennas will be acceptable for use in broadcasting signals in this range as well. Consequently, the antenna assembly 110 supports RF signals having frequencies in the bands that are specified by these wireless communication protocols. In certain embodiments, therefore, the first antenna 100 can handle signals in the 2.4 GHz band, the 5.0 GHz band, or dual bands (with the corresponding frequency channels) as specified by the IEEE 802.11, IEEE 802.15, and Bluetooth specifications. In this regard, the antenna assembly 110 is designed, fabricated, and tuned for operation at the desired frequency bands and channels. The antenna assembly 110 can be any acceptable antenna that can receive one or more of these frequencies. As a result, the antenna assembly 110 can receive many different frequencies.

Of course the antenna assembly 110 is also a receiving antenna as well. It can pick-up signals from sources that broadcast in the stated ranges, whether from cell phones, local Wi-Fi networks, NFC, Bluetooth devices or the like. It can receive these signals and transmit them via cable 180 to the motherboard.

Figure 18:
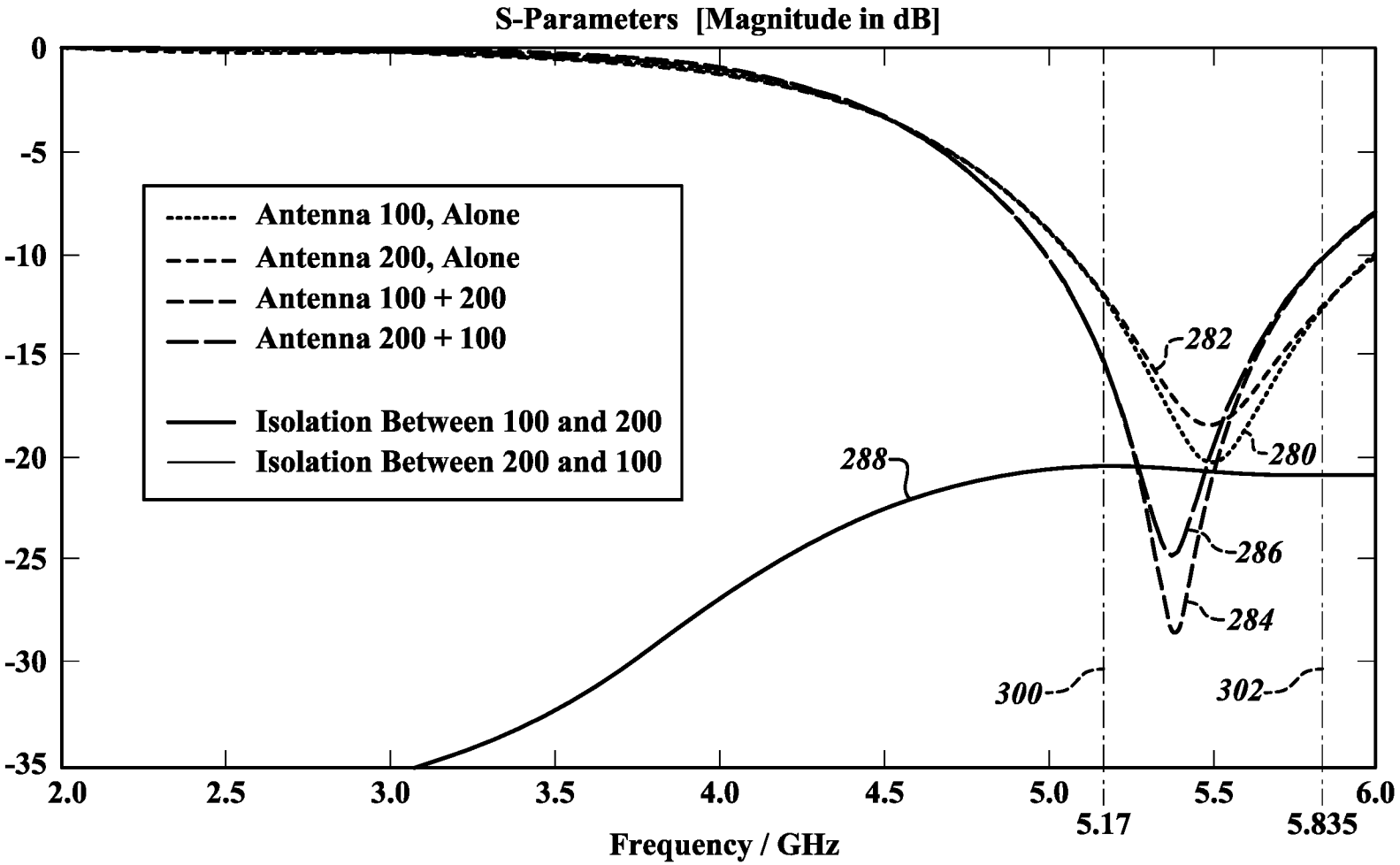
FIG. 18 is a graph showing the simulated input return losses of the first antenna and second antenna and also the combined antenna input return loss. It also shows the isolation performance between the first antenna and second antenna.

FIG. 18 is a graph showing the input return loss for various antenna combinations. It also shows, on the same graph, the isolation between antenna 100 and antenna 200. Since both of these features are measured in dB at specific frequencies, it is possible to put them both on the same graph, even though they represent quite different quantities.

Turning now to FIG. 18, the plot showing the input return loss on the graph of FIG. 18 will be first discussed. Line 280 represents the input return loss of antenna 100 being considered alone from frequencies between 2.0 and 6.0 GHz. For ease of highlighting the value at the frequencies of most interest, a vertical dash-dot line 300 is shown at 5.17 GHz, which is the frequency for the plots shown in FIGS. 9-11, and another dash-dot line 302 extends vertically at the 5.835 GHz mark, which is the frequency shown in the plots of FIGS. 15-17. Accordingly, this provides a focus on the performance of the antennas regarding their input return loss at the frequencies of most interest.

As can be seen in FIG. 18, the first antenna acting alone as indicated in plot 280 has an input return loss of approximately −12.2 dB at 5.17 GHz and an input return loss of −12.77 dB at 5.835 GHz. Both of these values are below −10 dB, which indicates that the performance will be acceptable at both of these frequencies. As is known in the art, it is desirable to have an input return loss that is less than −10 dB for good antenna performance. Therefore, when antenna 100 is transmitting alone, it will be within acceptable performance parameters.

Plot 282 in FIG. 18 shows the input return loss for antenna 200, transmitting alone. Antenna 200 will have an input return loss of approximately −12.09 dB at 5.17 GHz and an input return loss of approximately −12.631 dB at 5.835 GHz, as can be seen by noting where lines 300 and 302 intersect with plot 282.

Also shown on FIG. 18 is the performance of the combined antennas, when both are transmitting. Plot 284 is the performance of antennas 100+200 with respect to the input return loss. As can be seen, again looking at lines 300 and 302 in FIG. 18, the combined performance of antennas 100 and 200 has an input return loss of −15.325 dB at 5.17 GHz and −10.365 dB at 5.835 GHz. Therefore, transmission using a combination of antennas 100 and 200 is within the acceptable range of performance, and is significantly better than either one transmitting alone.

Plot 286 illustrates the input return loss for antenna 200+100. At these two data points, antenna 200+100 has nearly identical performance to antenna 100+200 (even though at approximately 5.4 GHz antenna 100+200 has better performance as is indicated by the more negative input return loss of line 284).

Accordingly, the plot illustrates that the input return loss of any combination of the antennas, whether acting alone or in various combinations with each other, are acceptable with respect to the input return loss parameter.

FIG. 18 also illustrates the isolation between the antennas during performance. In this plot, the isolation considered from antennas 100 to 200 and also from antenna 200 to 100 have both been plotted. They are so nearly identical to each other that the plots are shown as being exactly on top of each in FIG. 18. Namely, plot 288 shows the isolation between the antenna combination 100 and 200 as well as the isolation between the antenna combination of 200 and 100. Since the simulation output shows the isolation to be identical in the frequencies of interest, the plots are drawn directly on top of each other and are shown as a single plot 288 in the graph of FIG. 18. The isolation between the two antennas is below 20 dB at 5.17 GHz and at 5.835 GHz it is about −21 dB. In all cases it still remains below −20 dB and, therefore, is acceptable in performance.

In designing the antennas and, in particular, their placement with respect to each other on the substrate, there is a balancing of the tradeoff between the input return loss and the isolation. It is possible to modify the design to achieve more isolation; however, this will generally tend towards making a greater input return loss. Similarly, if the antenna design is maximized for the greatest input return loss, then in some instance this will create less isolation. Accordingly, the placement of the respective antennas, in combination with their shape and location, is selected to provide an acceptable input return loss, as well as good performance with respect to their isolation.

FIG. 18 illustrates that the antennas can be operated in any of the various combinations and still be within acceptable performance parameters. Namely, antenna 100 can be operated alone while antenna 200 remains idle. Similarly, antenna 200 may be operated alone. In most circumstance, antennas 100 and 200 will be operated together, as this will usually provide the highest performance. Thus, as can be seen in FIG. 18, the simulations illustrate that it is possible to operate the antennas in any of the various combinations which are available.

The locations and dimensions provided for these two antennas are advantageous to provide the combined radiation patterns shown. These locations and dimensions can be varied somewhat and still provide an effective antenna assembly. If desired, one, two, three or four antennas can be used as part of the antenna assembly to provide a range of radiation patterns.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. The various embodiments described above can be combined to provide further embodiments. Accordingly, the claims are not limited by the disclosure.

The invention claimed is:

1. An antenna assembly comprising:

a substrate having a cutout;

an antenna formed from the cutout, the antenna having:

a first section extending in a first direction from a surface of the substrate at an edge of the cutout, the first section connected to the substrate at the edge of the edge of the cutout;

a second section extending from the first section in parallel with the first section, a lower edge of the second section separated from the substrate by a first distance, an upper edge of the second section aligned with an upper edge of the first section; and a third section extending from the second section in parallel with the second section, a lower edge of the third section separated from the substrate by a second distance, the second distance being smaller than the first distance, an upper edge of the third section aligned with the upper edge of the second section; and a transmission cable having a first terminal physically and electrically connected to the third section.

2. The antenna assembly of claim 1, wherein the third section is adjacent to the second section in a direction transverse to the first direction.

3. The antenna assembly of claim 1, wherein the second section extends in a second direction transverse to the first direction, and the third section extends in a third direction different than the second direction.

4. The antenna assembly of claim 1, further comprising:

a fourth section extending from the third section in parallel with the third section, the fourth section being spaced apart from the substrate at a fourth distance that is greater than the second distance.

5. The antenna assembly of claim 1, wherein the substrate, the first section, the second section, and third section are a single monolithic piece.

6. The antenna assembly of claim 1, wherein the substrate and the antenna are comprised of metal.

7. The antenna assembly of claim 1, wherein the third section is not directly connected to the substrate.

8. The antenna assembly of claim 1, further comprising:

a cover positioned over the first section, the second section, and the third section, and being comprised of plastic.

9. The antenna assembly of claim 1, wherein a size of the antenna is equal to or smaller than a size of the cutout.

10. The antenna assembly of claim 1, wherein the first section extends in the first direction that is traverse from the surface of the substrate at the edge of the cutout.

* * * * *